US008141644B2

(12) United States Patent
Ellis

(10) Patent No.: US 8,141,644 B2
(45) Date of Patent: Mar. 27, 2012

(54) SYSTEM, METHOD, AND APPARATUS FOR A CORROSION-RESISTANT SLEEVE FOR RISER TENSIONER CYLINDER ROD

(75) Inventor: Fife B. Ellis, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 582 days.

(21) Appl. No.: 11/226,573

(22) Filed: Sep. 14, 2005

(65) Prior Publication Data

US 2007/0056739 A1 Mar. 15, 2007

(51) Int. Cl.
*E21B 17/01* (2006.01)
*B21D 39/04* (2006.01)
*B21D 39/20* (2006.01)

(52) U.S. Cl. ..... 166/355; 166/367; 29/523; 72/370.06

(58) Field of Classification Search ..... 166/350–355, 166/367, 345; 92/117 R, 118, 161, 172, 92/255; 148/527–436; 29/888, 523; 72/370.1, 72/370.03, 370.06–370.08, 283
See application file for complete search history.

(56) References Cited

U.S. PATENT DOCUMENTS 2,728,136 A * 12/1955 Fromson ..... 228/158
3,156,976 A * 11/1964 Whiting ..... 228/131
3,620,119 A * 11/1971 King, Jr. ..... 411/399
3,695,149 A * 10/1972 Eberhart ..... 92/168
3,716,649 A * 2/1973 Smith et al. ..... 174/7
4,049,239 A * 9/1977 Howell ..... 166/355
4,300,379 A * 11/1981 Johnson et al. ..... 72/258
4,379,657 A * 4/1983 Widiner et al. ..... 405/224.4
4,640,641 A * 2/1987 Edelmayer ..... 403/150
4,733,991 A * 3/1988 Myers ..... 405/224.2
4,759,256 A * 7/1988 Kovit et al. ..... 91/29
4,787,778 A * 11/1988 Myers et al. ..... 405/224.4
4,799,827 A * 1/1989 Jaqua ..... 405/224.4
4,883,387 A * 11/1989 Myers et al. ..... 405/224.4
4,886,392 A * 12/1989 Iio ..... 403/282
4,921,755 A * 5/1990 Carroll et al. ..... 428/328
5,069,488 A * 12/1991 Freyer et al. ..... 285/302
5,447,399 A * 9/1995 Yoshida et al. ..... 411/383
5,477,771 A * 12/1995 Black ..... 92/5 R
(Continued)

OTHER PUBLICATIONS

Semiatin, S. L. (2005; 2-009). ASM Handbook, vol. 14A—Metalworking: Bulk Forming. (pp. 837). ASM International. Online version available at: http://www.knovel.com/web/portal/browse/display?_EXT_KNOVEL_DISPLAY_bookid-3131&VerticalID-0.*

*Primary Examiner* — Thomas Beach
*Assistant Examiner* — Kelly Shaw
(74) *Attorney, Agent, or Firm* — Bracewell & Giuliani LLP

(57) ABSTRACT

A riser tensioner cylinder rod incorporates a thin, corrosion-resistant alloy tube over a pre-machined steel alloy rod. The tube is swedged at one end and expanded to the inner surface of a split die. A gradual tapered surface on a stretching die provides a smooth transition during a stretching process for the tube. A pressurizing vessel traps an outer lip of the pre-swedged tube. Pressurized fluid in the vessel simultaneously causes the tube to expand and force the rod into the tube inner diameter. At the completion of the process, the pressurizing vessel is removed. The stretched tube is parted off at both ends and the stretching die is removed from the rod to complete the assembly.

19 Claims, 4 Drawing Sheets

U.S. PATENT DOCUMENTS 5,568,760 A * 10/1996 Volzer ..... 92/5 R
5,651,303 A * 7/1997 Fish ..... 92/128
5,846,028 A * 12/1998 Thory ..... 405/195.1
6,189,663 B1 * 2/2001 Smith et al. ..... 188/322.22
6,418,970 B1 * 7/2002 Deul ..... 138/31
6,439,103 B1 * 8/2002 Miller ..... 92/128
6,560,846 B1 * 5/2003 Shioya et al. ..... 29/525
6,688,814 B2 * 2/2004 Wetch et al. ..... 405/224.2
6,869,254 B1 * 3/2005 Kershman ..... 405/224.4
7,231,981 B2 * 6/2007 Moe et al. ..... 166/355
7,563,496 B2 * 7/2009 Watson ..... 428/35.7
2005/0147473 A1 * 7/2005 Pallini et al. ..... 405/224.4
2005/0251987 A1 * 11/2005 Urech et al. ..... 29/508

* cited by examiner

SYSTEM, METHOD, AND APPARATUS FOR A CORROSION-RESISTANT SLEEVE FOR RISER TENSIONER CYLINDER ROD

BACKGROUND OF THE INVENTION

1. Technical Field

The present invention relates in general to offshore drilling rig riser tensioners and, in particular, to an improved system, method, and apparatus for corrosion-resistant sleeves for riser tensioner cylinder rods.

2. Description of the Related Art

Some types of offshore drilling rigs utilize "push-up" or "pull-up" type riser tensioners. The riser tensioner incorporates cylinder rods to maintain tension on the riser. The cylinder rods are subjected to a very corrosive environment caused by exposure to drilling muds, completion fluids, and general offshore environments. As a result, the rods currently being used are made from either a solid nickel-based alloy or a laser-clad cobalt-based layer that is applied to a steel alloy rod. Both of these current rod options are expensive and, in the case of cladding, result in long lead times with multiple processes. Consequently, there is a higher probability for damaged parts and scrap or scrappage. Thus, an improved design for riser tensioner cylinder rods would be desirable.

SUMMARY OF THE INVENTION

One embodiment of a system, method, and apparatus for improving the cylinder rods for riser tensioners. The present invention overcomes the shortcomings of the prior art by stretching a thin tube over a pre-machined steel alloy rod by using hydraulic pressure. In one embodiment, the tube is formed from a corrosion-resistant alloy. This design results in a much lower manufacturing cost (approximately one-third less than current technology) and shorter manufacturing lead times. The manufacturing process for installing the sleeve involves the use of hydraulic pressure to simultaneously stretch the sleeve and press or push the pre-machined rod into the sleeve.

In one embodiment, a thin alloy tube is hydraulically swedged out at one end with a split die and inner plug. Hydraulic fluid is introduced through the plug port causing the thin tube to expand to the inside surfaces of the die. Following the swedging operation, the die is removed and the end of the tube is trimmed. A stretching die has a lip seal at one end. Internal threads at the opposite end thread onto the pre-machined rod and seals against the inside diameter of the thin tube. A gradual tapered surface on the stretching die provides a smooth transition during the stretching process. A pressurizing vessel comprises two flanged parts that "sandwich" or trap the outer lip of the pre-swedged tube. A threaded port at one end allows hydraulic fluid to enter during the stretching operation. Pressurized hydraulic fluid is introduced to the port to simultaneously cause the tube to expand and force the rod into the tube inner diameter. At the completion of the process, the pressurizing vessel is removed. The stretched tube is parted off at both ends and the stretching die is removed from the rod.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
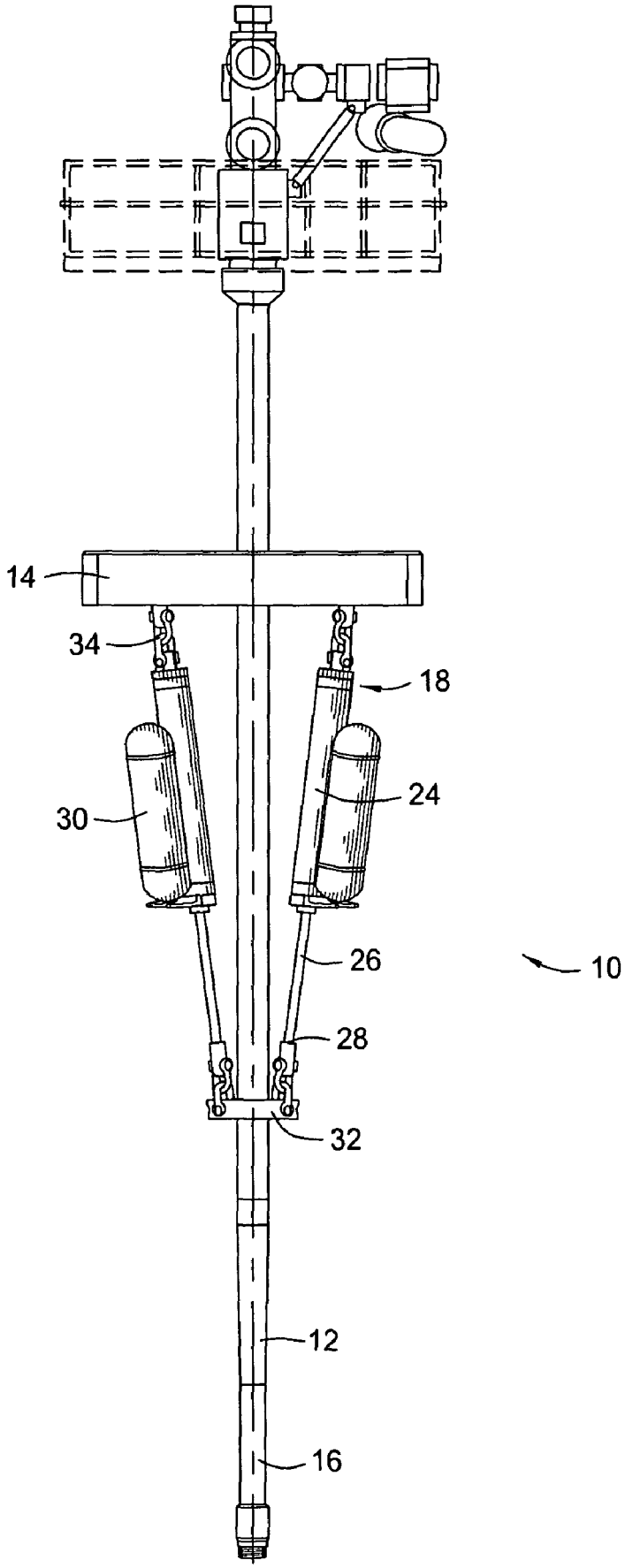
FIG. 1 is a partial sectional view of one type of floating platform with a riser supported by a tensioning mechanism constructed in accordance with the present invention.

Referring to FIG. 1, one type of riser tensioning mechanism 10 is depicted. Although mechanism 10 is depicted as a "pull-up" type, one skilled in the art will recognize that the present invention is equally suitable for "push-up" type and other types of tensioning mechanisms.

A riser 12 extends downwardly from a platform 14 to a subsea wellhead (not shown). Riser 12 has a longitudinal axis 16 and is surrounded by a plurality of hydraulic cylinders 18. Each hydraulic cylinder 18 has a cylinder housing 24 having a chamber (not shown). A piston rod 26 having a rod end 28 extends upward from each cylinder housing 24 of hydraulic cylinder 18. The piston ends opposite rod ends 28 are disposed within the respective chambers (not shown) of cylinder housings 24. Hydraulic fluid (not shown) is contained within the housing 24 for pushing piston rod 26 upward. Each hydraulic cylinder 18 also has accumulator 30 for accumulating hydraulic fluid from hydraulic cylinder 18 and for maintaining high pressure on the hydraulic fluid. A riser collar 32 rigidly connects to riser 12. The piston rods 26 attach to riser collar 32 at the rod ends 28. Cylinder shackles 34 rigidly connect cylinder housings 24 to platform 14.

In operation, the riser tensioning mechanism 10 pulls upward on riser 12 to maintain tension therein. Riser collar 32 connects to riser 12 and engages riser 12 above platform 14 and cylinder receiver 18. Hydraulic fluid pressure is applied to hydraulic cylinders 18 so that riser 12 is maintained in constant tension. Riser collar 32 supports the weight of riser 12 in order to create a tensional force in riser 12. Hydraulic cylinders 18 automatically adjust to changes in platform 14 position to allow for relative movement between riser 12 and platform 14. In the event of a failure in one of the four hydraulic cylinders 18, the remaining hydraulic cylinders 18 will continue to support riser 12 in tension without excessive bending moments being applied to the hydraulic cylinders 18.

Figure 2:
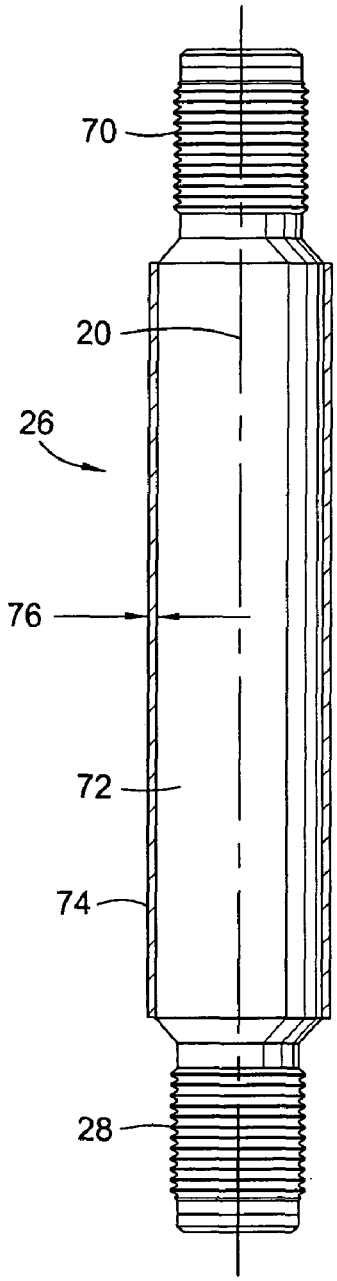
FIG. 2 is a partially sectioned side view of one embodiment of a piston rod for a riser tensioning mechanism and is constructed in accordance with the present invention.

Referring now to FIG. 2, one embodiment of a piston rod 26 constructed in accordance with the present invention is shown. As described above, piston rod 26 has axis 20 and includes a threaded rod end 28 and a piston end 70 that locates in cylinder housing 24. Piston rod 26 also comprises a shank 72 that extends and is located between ends 28, 70. Piston rod 26 is formed from a pre-machined steel alloy, such as commonly available, inexpensive steel alloys. In addition, the outer surface of shank 72 is enveloped by and protected with a thin, corrosion-resistant material covering 74. In one embodiment, it is only shank 72 that is covered by covering 74. Covering 74 may have a radial thickness 76 in the range 0.005 to 1.0 inches. The covering 74 itself may comprise many different forms including a tube, coating, or still other suitable coverings for protecting piston rod 26 from corrosion.

Figure 3:
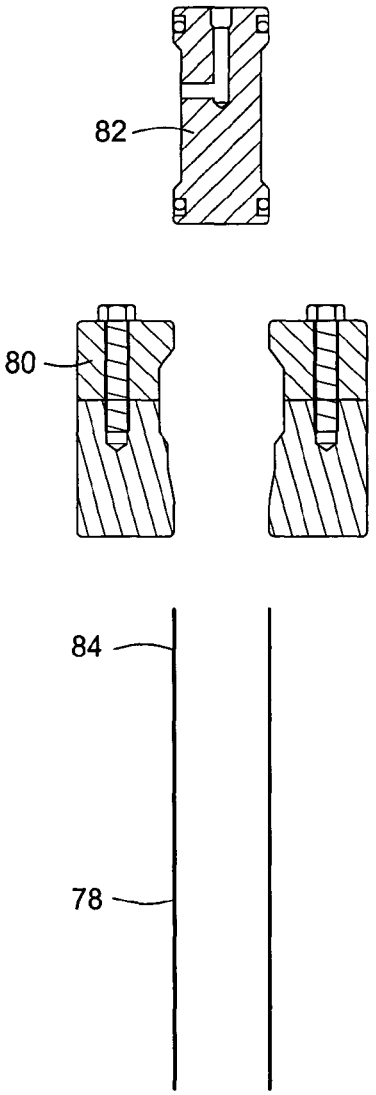
FIG. 3 is an exploded sectional side view of a covering, a forming die, and a plug utilized by one embodiment of a method in accordance with the present invention.
Figure 4:
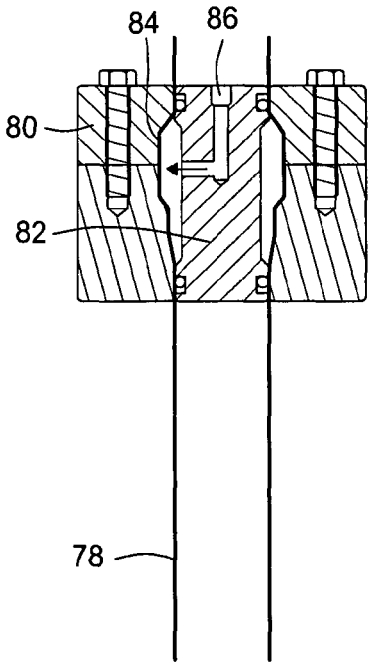
FIG. 4 is a sectional side view of the covering, die, and plug of FIG. 3 shown during a pressure forming operation in accordance with the present invention.

One embodiment of a method for joining covering 74 to piston rod 26 is depicted in FIGS. 3-9. In this embodiment, the covering 74 is formed from a thin tube 78 of corrosion-resistant alloy, such as nickel or cobalt-based alloys. Tube 78 may be joined to piston rod 26 via a series of operations. In one embodiment, a forming die, such as a split forming die 80 (FIG. 3) is used in conjunction with a plug 82 to swedge one end 84 of tube 78. As shown in FIG. 4, the plug 82 is placed inside tube 78 adjacent to one axial end. The tube 78 and plug 82 are then positioned inside the split forming die 80. The plug 82 is pressurized with hydraulic fluid via port 86 to expand and plastically deform the end 84 of tube 78 to the inner surfaces of split forming die 80 as shown. Split forming die 80 and plug 82 are subsequently removed from tube 78 (FIG. 5), and a portion 88 of tube 78 is trimmed, leaving a swedged flange 90 on end 84 of tube 78.

Figure 5:
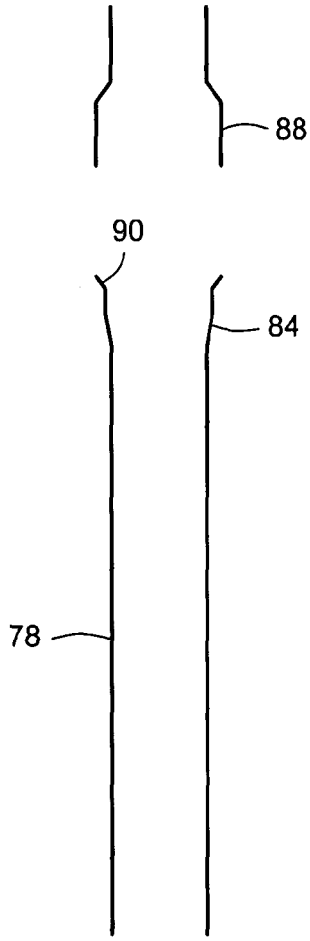
FIG. 5 is a sectional side view of the covering after the forming operation of FIG. 4 and is constructed in accordance with the present invention.

Referring now to FIGS. 3-9, the tube 78 may be joined to piston rod 26 via a variety of methods, including a stretching operation. One embodiment of the stretching operation employs a pressurizing vessel 92 and a stretching die 94. The piston rod 26 may be fabricated by first forming a retention feature 90 on one end of a tube 78 as shown in the sequence of FIGS. 3-5. In one embodiment, the method comprises swedging one end 84 of the tube 78 and trimming a portion 88 of the swedged end 84 of the tube 78 to form a flange 90 on the end 84 of the tube 78.

Figure 6:
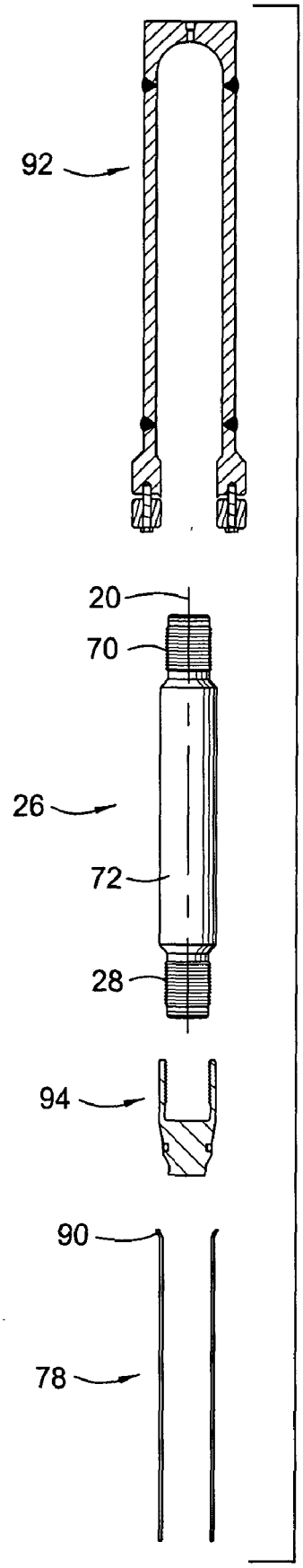
FIG. 6 is an exploded sectional side view of the covering of FIG. 5, a stretching die, a pre-machined rod, and a pressurizing vessel utilized in accordance with the present invention.
Figure 7:
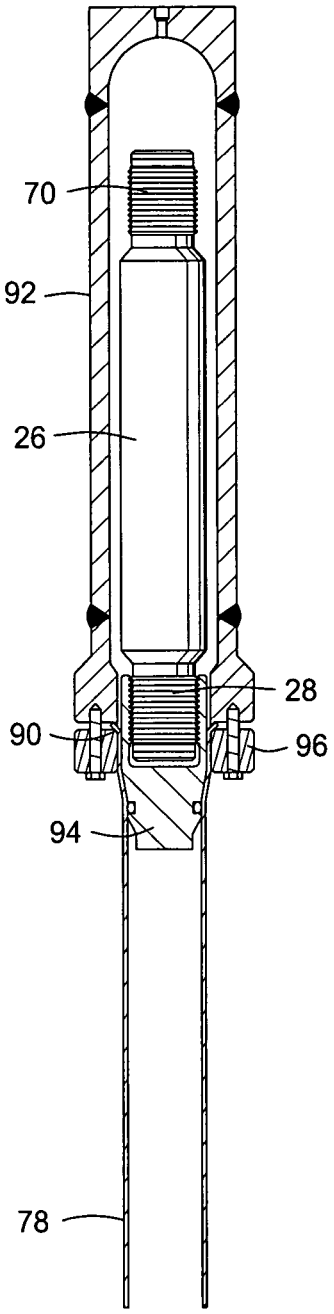
FIG. 7 is a sectional side view of the covering, die, rod, and vessel of FIG. 6 shown at the start of one embodiment of a stretching operation in accordance with the present invention.
Figure 8:
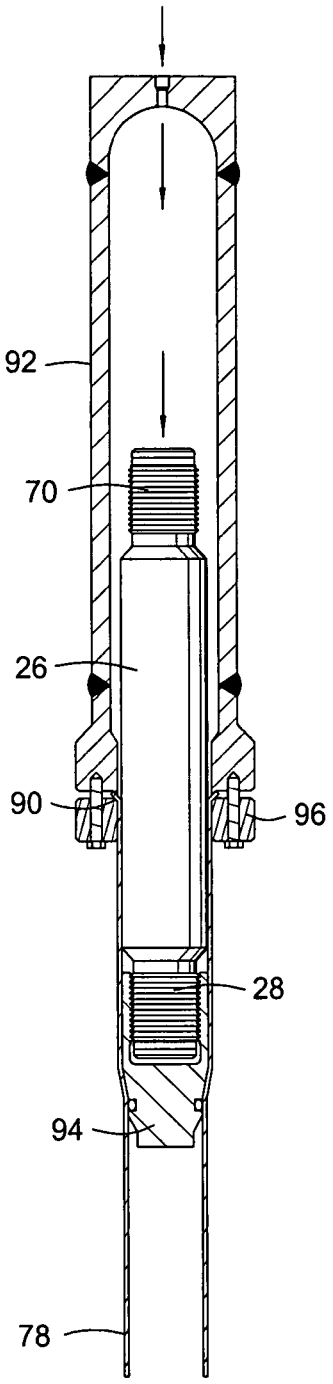
FIG. 8 is a sectional side view of the covering, die, rod, and vessel of FIG. 6 shown during the stretching operation and is constructed in accordance with the present invention.
Figure 9:
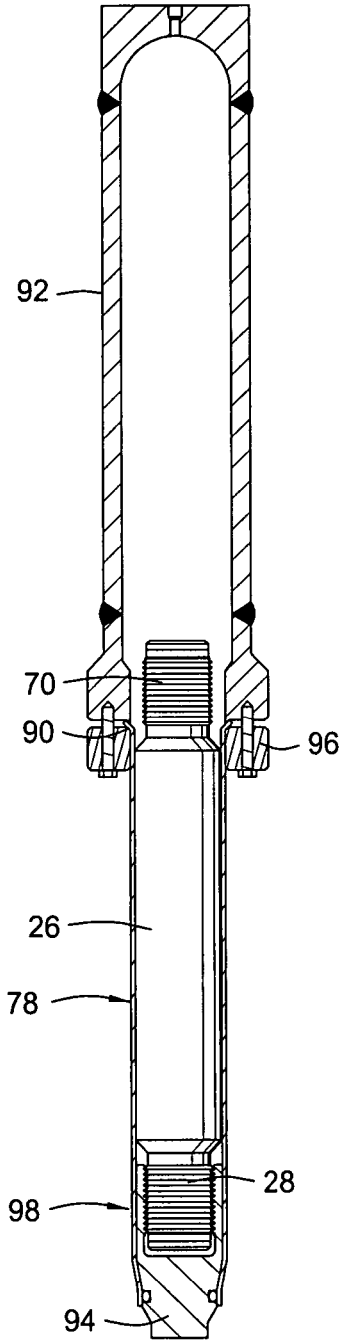
FIG. 9 is a sectional side view of the covering, die, rod, and vessel of FIG. 6 shown after the stretching operation and is constructed in accordance with the present invention.

As shown in FIG. 6, a die 94, such as a stretching die, is mounted to one end (e.g., threaded rod end 28) of the piston rod 26. At least a portion of the piston rod 26 (e.g., shank 72 and piston end 70) are positioned in a pressurizing vessel 92 (FIG. 7). The threaded rod end 28 and the stretching die 94 may protrude from the pressurizing vessel 92. The method further comprises securing the retention feature 90 (e.g., the flange) of the tube 78 to the pressurizing vessel 92 (e.g., via a clamping device 96 in FIG. 7) and locating at least a portion of the die 94 inside the tube 78. The pressurizing vessel 92 is pressurized (FIG. 8) and axially forces the die 94 and the piston rod 26 into the tube 78 to form an assembly (FIG. 9) of the piston rod 26 and tube 78.

The assembly is then removed from the pressurizing vessel 92 and the die 94 is removed from the assembly. One or more portions of the tube 78 are then trimmed from the assembly. The method may comprise trimming the retention feature 90 and a portion 98 (FIG. 9) of the tube 78 adjacent the threaded rod end 28 of the piston rod 26 such that only the shank 72 of the piston rod 26 is covered by the covering 74 (FIG. 2).

While the invention has been shown or described in only some of its forms, it should be apparent to those skilled in the art that it is not so limited, but is susceptible to various changes without departing from the scope of the invention.

What is claimed is:

1. A riser tensioning mechanism, comprising:

a riser extending downward from a platform to a subsea wellhead;

a plurality of hydraulic cylinders, each having a piston rod extending from a cylinder housing for supporting the riser relative to the platform; and a tubular covering that is not a coating covering the piston rod, the tubular covering comprising a metallic alloy and having an inner diameter smaller than an outer diameter of the piston rod prior to being stretched over and radially deformed and positioned on an outer surface of the piston rod to protect the piston rod from corrosion.

2. A riser tensioning mechanism according to claim 1, wherein the piston rod further comprises a body with an axis, a shanking having an outer surface, a threaded rod end, and a piston end, the body is formed from a pre-machined steel alloy, and the covering is positioned on the outer surface of the body between the threaded rod end and the piston end.

3. A riser tensioning mechanism according to claim 1, wherein the covering has a radial thickness in a range of 0.005 to 1.0 inches.

4. A riser tensioning mechanism according to claim 1, wherein the covering comprises a tube that is stretched radially over the piston rod.

5. A riser tensioning mechanism according to claim 1, wherein the metallic alloy comprises a corrosion-resistant alloy.

6. A riser tensioning mechanism according to claim 5, wherein the corrosion-resistant alloy comprises a nickel-based alloy.

7. A riser tensioning mechanism according to claim 1, wherein the metallic alloy comprises a cobalt-based alloy.

8. A riser tensioning mechanism according to claim 1, wherein the piston rod comprises a steel alloy.

9. A riser tensioning mechanism, comprising:

a plurality of hydraulic cylinders adapted to support a riser relative to a platform, wherein each hydraulic cylinder comprises:

a housing;

a piston rod extending from the housing to support the riser; and a tubular cover that is not a coating, the tubular cover being disposed over the piston rod and having an inner diameter smaller than an outer diameter of the piston rod prior to being deformed radially outwardly and positioned on an outer surface of the piston rod.

10. The riser tensioning mechanism as recited in claim 9, wherein the tubular cover comprises a corrosion-resistant alloy.

11. The riser tensioning mechanism as recited in claim 10, wherein the corrosion-resistant alloy comprises a nickel-based alloy.

12. The riser tensioning mechanism as recited in claim 10, wherein the corrosion-resistant alloy comprises a cobalt-based alloy.

13. A riser tensioning mechanism according to claim 9, wherein the piston rod comprises a steel alloy.

14. A riser tensioning mechanism comprising:

a plurality of hydraulic cylinders adapted to support a riser relative to a platform, wherein each hydraulic cylinder comprises:

a housing;

a piston rod extending from the housing to support the riser; and a tubular metallic cover not a coating, disposed over the piston rod and having an inner diameter smaller than an outer diameter of the piston rod prior to being deformed radially outwardly and positioned on the piston rod.

15. The riser tensioning mechanism as recited in claim 14, wherein the tubular metallic cover comprises a radially deformed cylindrical portion.

16. The riser tension in mechanism as recited in claim 14, wherein the tubular cover comprises a corrosion-resistant alloy.

17. The riser tensioning mechanism as recited in claim 16, wherein the corrosion-resistant alloy comprises a nickel-based alloy.

18. The riser tensioning mechanism as recited in claim 16, wherein the corrosion-resistant alloy comprises a cobalt-based alloy.

19. The riser tensioning mechanism as recited in claim 14, wherein the piston rod comprises a steel alloy.

* * * * *